US009865951B2

(12) United States Patent
Liang et al.

(10) Patent No.: US 9,865,951 B2
(45) Date of Patent: Jan. 9, 2018

(54) CONNECTOR FOR FLEXIBLE PRINTED CIRCUIT BOARD

(71) Applicant: ALLTOP ELECTRONICS (SUZHOU) LTD., Taicang, JiangSu Province (CN)

(72) Inventors: Li-Li Liang, Tai Cang (CN); Yong-Gang Zhang, Tai Cang (CN); Yu-Hui Zhang, Tai Cang (CN)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 15/645,723

(22) Filed: Jul. 10, 2017

(65) Prior Publication Data

US 2017/0324178 A1 Nov. 9, 2017

Related U.S. Application Data

(63) Continuation-in-part of application No. 15/232,992, filed on Aug. 10, 2016, now Pat. No. 9,735,486.

(30) Foreign Application Priority Data

May 6, 2016 (CN) ..... 2016 1 0296947
Jun. 16, 2017 (CN) ..... 2017 1 0455490

(51) Int. Cl.

| | |
|---|---|
| ***H01R 12/00*** | (2006.01) |
| ***H01R 12/77*** | (2011.01) |
| ***H01R 13/52*** | (2006.01) |
| ***H01R 13/436*** | (2006.01) |
| ***H01R 13/627*** | (2006.01) |
| ***H01R 12/70*** | (2011.01) |

(52) U.S. Cl.
CPC ..... *H01R 12/778* (2013.01); *H01R 12/707* (2013.01); *H01R 13/4367* (2013.01); *H01R 13/5202* (2013.01); *H01R 13/5221* (2013.01); *H01R 13/6273* (2013.01)

(58) Field of Classification Search
CPC ..... H01R 12/778; H01R 12/707; H01R 13/5221; H01R 13/4367; H01R 13/6273; H01R 13/5202
USPC ..... 439/59, 65, 67, 77, 79
See application file for complete search history.

(56) References Cited

U.S. PATENT DOCUMENTS

| | | | |
|---|---|---|---|
| 5,934,933 | A | 8/1999 | Kordecki et al. |
| 6,159,023 | A | 12/2000 | Lai |
| 8,636,533 | B1 | 1/2014 | Yen |
| 2009/0291596 | A1 | 11/2009 | Miyazoe |
| 2011/0237101 | A1 | 9/2011 | Yang |

*Primary Examiner* — Khiem Nguyen
(74) *Attorney, Agent, or Firm* — Sughrue Mion, PLLC

(57) ABSTRACT

An electrical connector includes an insulative housing, a plurality of contacts retained in the insulative housing, a fastener and a first sealing ring. The insulative housing has a rear section extending backwardly. The rear section has a rear space and a first peripheral wall around the rear space. Each contact has a connecting leg extending into the rear space. The fastener has a mating section to engage with the rear section and a board receiving chamber extending therethrough along a front to back direction. The fastener has a fixed position on the insulative housing, and as moving the fastener to the fixed position, the connecting legs are pressed into the board receiving chamber for electrically connecting with the flexible printed circuit board, and the first sealing ring is sealed around the junction of the contacts and the flexible printed circuit board.

15 Claims, 7 Drawing Sheets

CONNECTOR FOR FLEXIBLE PRINTED CIRCUIT BOARD

CROSS REFERENCE TO RELATED APPLICATIONS

The present application is a continuation-in-part application of U.S. patent application Ser. No. 15/232,992 filed on Aug. 10, 2016, and claims the priority of Chinese Patent Application No. 201710455490.8, filed on Jun. 16, 2017 and Chinese Patent Application No. 201610296947.0, filed on May 6, 2016, the contents of all of which are incorporated herein by reference in their entirety.

BACKGROUND

1. Technical Field

The present disclosure relates to an electrical connector, and more particularly to a connector for flexible printed circuit board with well waterproof performance

2. Description of Related Art

A connector for flexible printed circuit board is used to electrically connect a flexible printed circuit board with a mating connector or a mother board. A normal connector for flexible printed circuit board usually has an insulative housing, a number of contacts retained in the insulative housing and an actuator. The actuator is rotatably mounted to the insulative housing for retaining a flexible printed circuit board to the insulative housing, and making the contacts and the flexible printed circuit board electrically connect with other. However, because of the rotatably operation of the actuator, the connection portion between the contacts and the flexible printed circuit board is difficult to be sealed for waterproof, then the performance of the signal transmission would be adversely affected.

It is desirable to provide an improved connector for flexible printed circuit board for solving above problems.

SUMMARY

In one aspect, the present invention includes a connector for flexible circuit board. The connector includes an insulative housing, a plurality of contacts retained in the insulative housing, a fastener and a first sealing ring. The insulative housing has a rear section extending backwardly. The rear section has a rear space and a first peripheral wall around the rear space. Each contact has a connecting leg extending into the rear space. Each connecting leg has a connecting portion and a resisting portion connecting with each other. The connecting portion and the resisting portion of each connecting leg are located at different level surfaces. The fastener has a base, a mating section forwardly extending from the base and a board receiving chamber extending therethrough along a front to back direction. The mating section defines a contact receiving chamber communicating with the board receiving chamber along a top to bottom direction and a press section. The first sealing ring is arranged between the first peripheral wall and the mating section of the fastener. The insulative housing has a fixed position to fix the fastener, and as moving the fastener to the fixed position, the press section presses against the resisting portion to drive the connecting portion projecting into the board receiving chamber, and the first sealing ring is sealed between the first peripheral wall and the mating section.

In another aspect, the present invention includes a connector for flexible circuit board. The connector includes an insulative housing, a plurality of contacts retained in the insulative housing, a fastener and a first sealing ring. The insulative housing has a rear section extending backwardly. The rear section has a rear space and a first peripheral wall around the rear space. Each contact has a connecting leg extending into the rear space. The fastener has a mating section to engage with the rear section and a board receiving chamber extending therethrough along a front to back direction. The insulative housing has a fixed position to fix the fastener, and as moving the fastener to the fixed position, the connecting legs are pressed into the board receiving chamber for electrically connecting with the flexible printed circuit board, and the first sealing ring is sealed around a junction of the contacts and the flexible printed circuit board.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
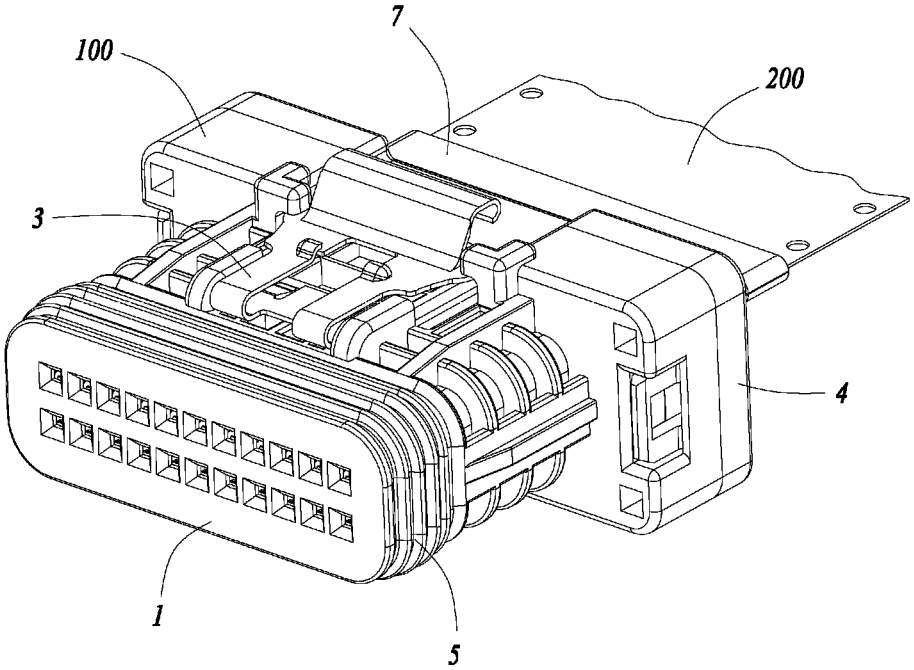
FIG. 1 is a perspective view illustrating a preferred embodiment of a connector for flexible printed circuit board connected with the flexible printed circuit board in the present disclosure.
Figure 2:
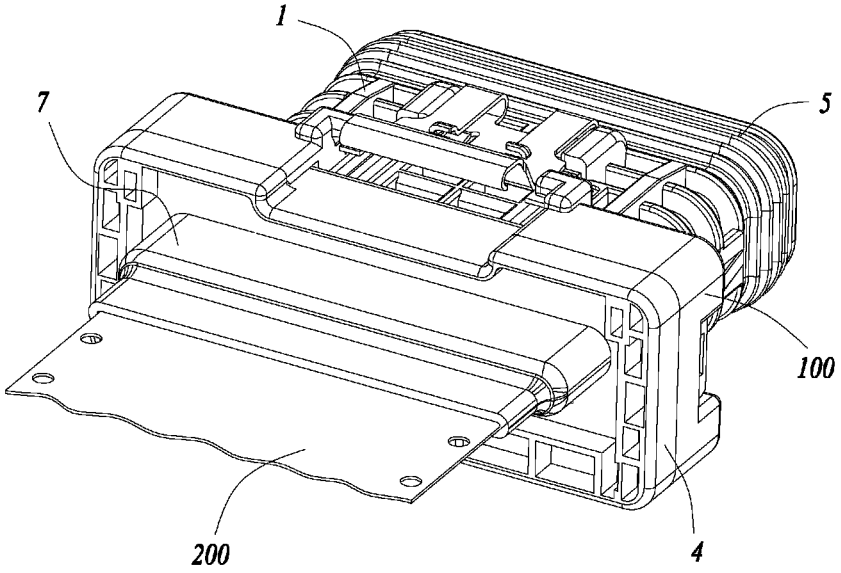
FIG. 2 is a view similar to FIG. 1, while viewed from another aspect.
Figure 3:
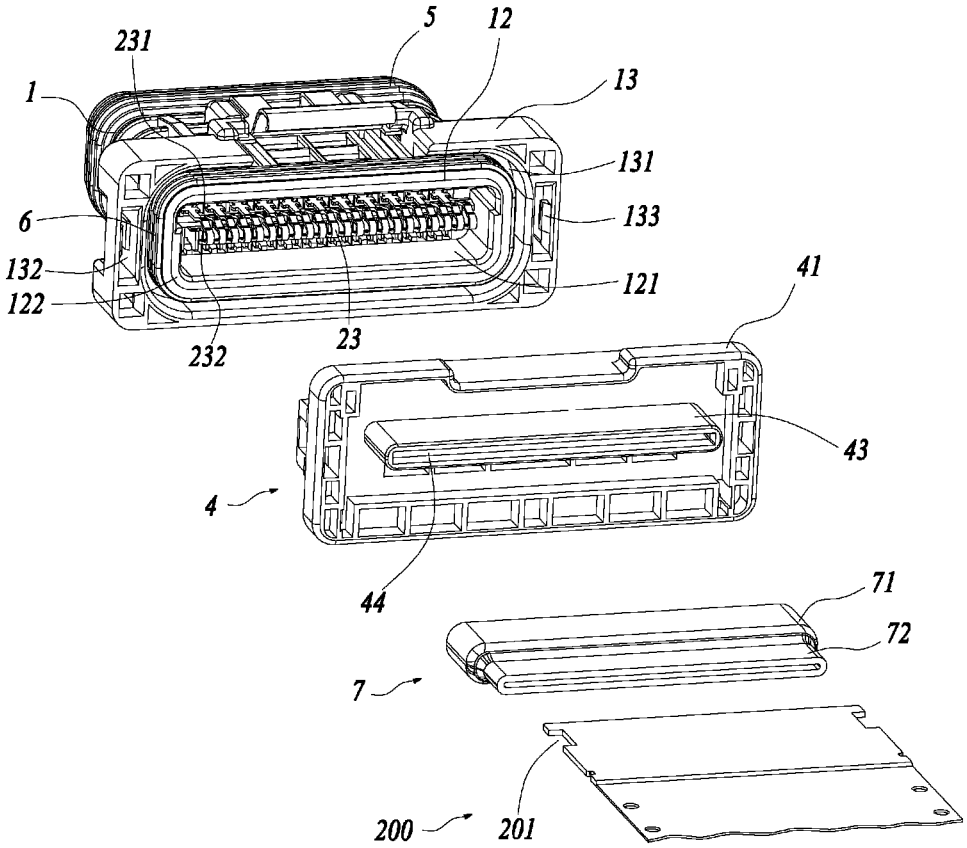
FIG. 3 is a partially exploded view of the connector and the flexible printed circuit board shown in FIG. 1.
Figure 4:
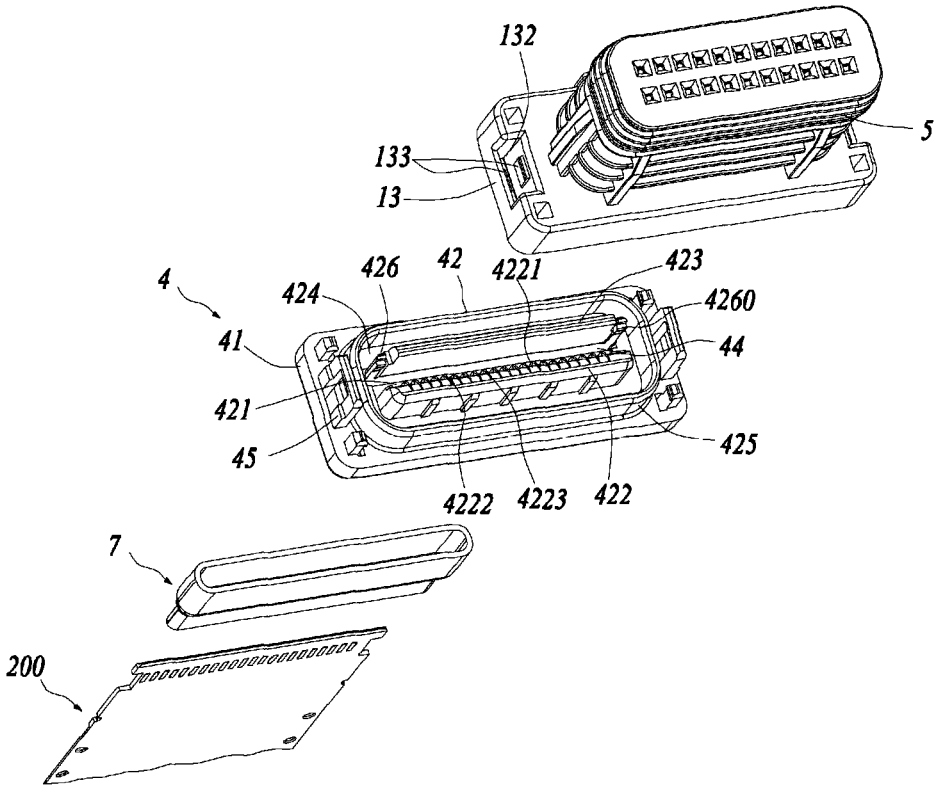
FIG. 4 is a view similar to FIG. 3, while viewed from another aspect.

Reference will now be made to the drawing figures to describe the embodiments of the present disclosure in detail. In the following description, the same drawing reference numerals are used for the same elements in different drawings.

Referring to FIGS. 1 to 8, a preferred illustrated embodiment of the present disclosure discloses a connector 100 for flexible printed circuit board 200. The connector 100 comprises an insulative housing 1, a plurality of contacts 2 retained in the insulative housing 1, a locking element 3, a fastener 4 and several sealing elements.

Figure 5:
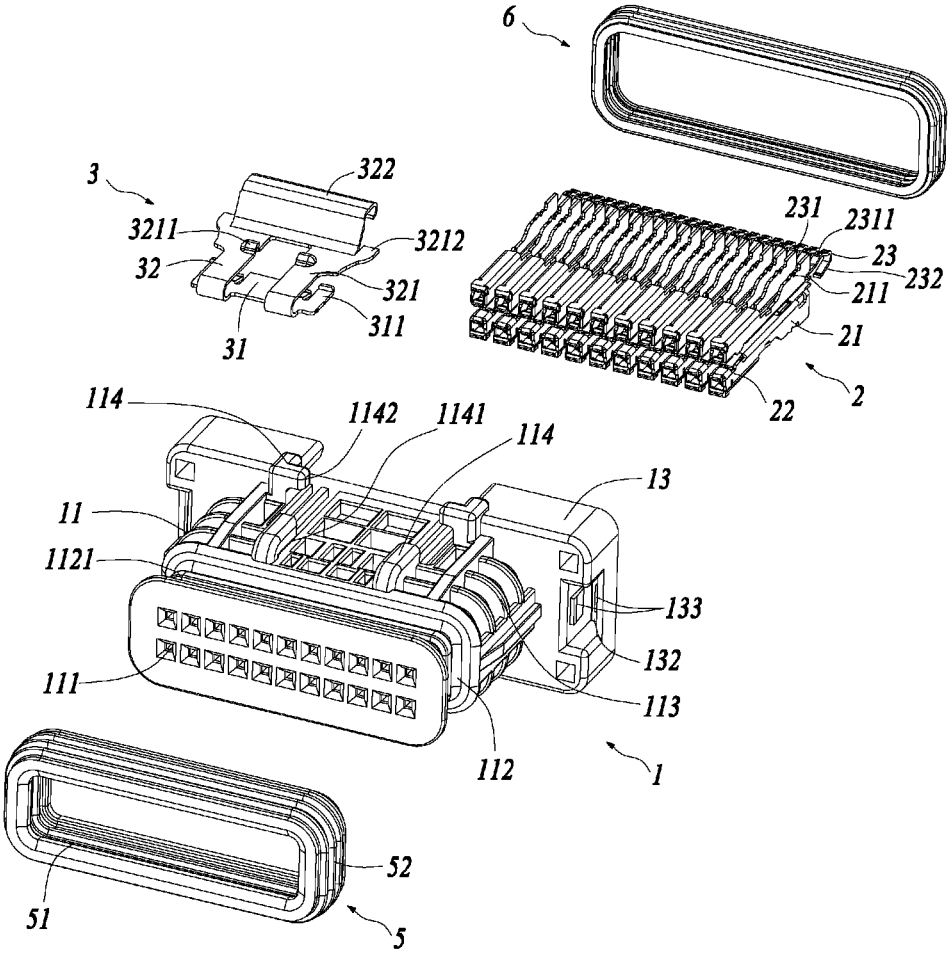
FIG. 5 is an exploded view of a part of the connector shown in FIG. 1.
Figure 6:
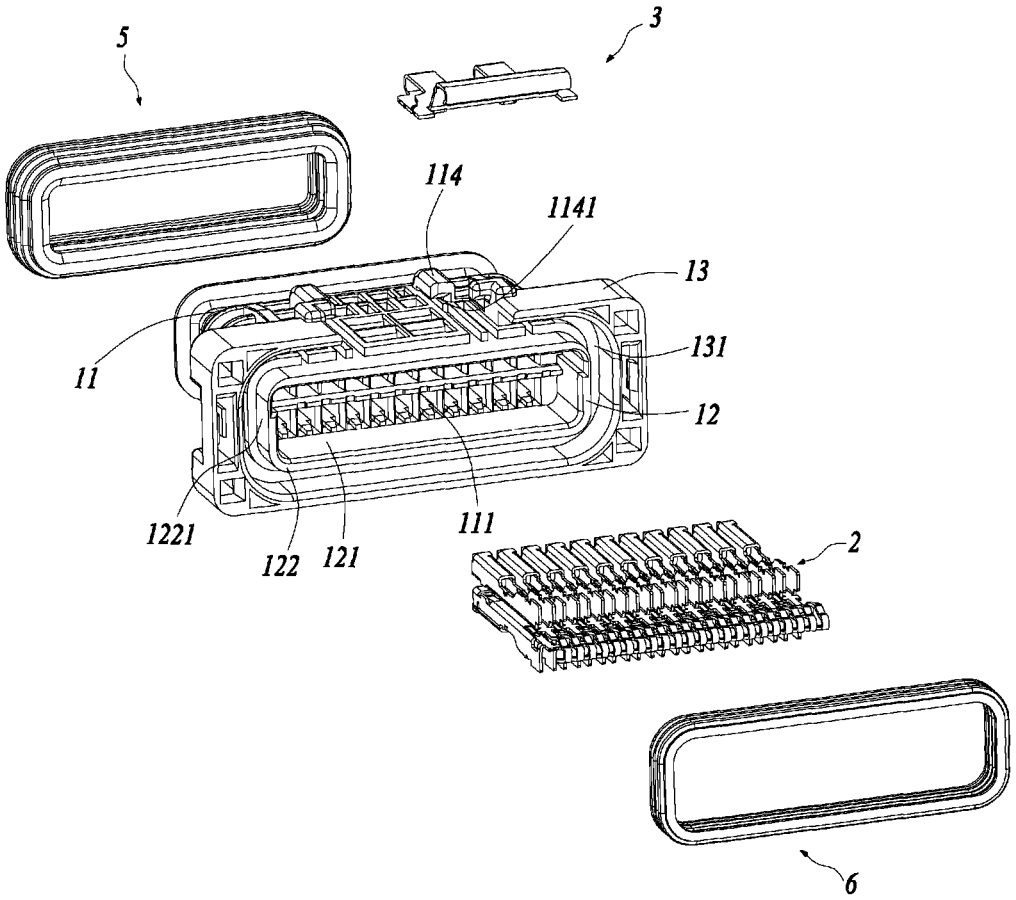
FIG. 6 is a view similar to FIG. 5, while viewed from another aspect.

Please refer to FIGS. 5 and 6, the insulative housing 1 has a body section 11, a rear section 12 and a plurality of fixing walls 13 backwardly extending from the body section 11. The fixing walls 13 surround the rear section 12. A receiving space 131 is formed between the fixing walls 13 and the rear section 12.

The body section 11 is provided with a plurality of passageways 111 extending therethrough along a front to back direction, an annular slot 112 recessed from the outer surfaces thereof, a plurality of protruding ribs 113 extending along the front to back direction or a transverse direction at the outer surfaces, and two pairs of position blocks 114 outwardly extending from the top surface thereof.

The passageways 111 are arranged in two rows along a top to bottom direction.

The annular slot 112 extends along a circumferential direction at a front side of the body section 11, and is formed with several retentive ribs 1121 protruding from the inner surface thereof. The retentive ribs 1121 extend along the circumferential direction of annular slot 112.

The sealing elements comprise a second sealing ring 5. The second sealing ring 5 is received in the annular slot 112 to engage with a mating connector (not shown), so that the junction portion between the connector and the mating connector is sealed for waterproof. The second sealing ring 5 defines several depressions 51 depressed from the inner surfaces thereof. The depressions 51 fit with the retentive ribs 1121 to limit the second sealing ring 5 from moving along the front to back direction. Besides, the second sealing ring 5 further has a plurality of protrusions 52 extending along the circumferential direction thereof to strengthen the seal between the connector 100 and mating connector.

Said two pairs of position blocks 114 are spaced to each other along the front to back direction. The position blocks 114 of the front pair each defines an indentation 1141 at the opposite side thereof. The position blocks 114 of the rear pair are higher than that of the front pair, and each is formed with a projection 1142 extending toward each other.

The locking element 3 has a position blade 31, a locking arm 32 extending in a reverse direction from a rear end of the position blade 31. The position blade 31 is provided with a pair of position tabs 311 at two sides thereof. The position tabs 311 are retained in the indentations 1141 so as to fix the locking element 3 to the insulative housing 1.

The locking arm 32 has a locking portion 321 at a front side thereof and an operation portion 322 behind the locking portion 321. The locking portion 321 has a pair of locking embosses 3211 protruding upwardly to latch the mating connector. Besides, the locking arm 32 further has a pair of limiting tabs 3212 backwardly extending from two rear sides of the locking portion 321. The limiting tabs 3212 extend below the projections 1142 so as to limit the locking arm 32 from moving too upwardly.

The rear section 12 has a rear space 121 opening backwardly and a first peripheral wall 122 around the rear space 121. The rear space 121 communicates with the passageways 111, so that the contacts 2 can be assembled into the insulative housing 1 through the rear space 121.

The first peripheral wall 122 defines a recess 1221 recessed from the outer surface thereof. The recess 1221 extends along the circumferential direction of the first peripheral wall 122 at the rear end. The sealing elements further comprise a first sealing ring 6 retained in the recess 1221. As the fastener 4 is fixed to the insulative housing 1, the first sealing ring 6 seals the junction portion of the fastener 4 and the insulative housing 1, thereby water can not be immersed into the junction portion. The design of the first sealing ring 6 and the recess 1221 are similar to that of the second sealing ring 5 and the annular slot 112.

Please refer to FIGS. 1 to 4, the insulative housing 1 is provided with a fixing structure. The fastener 4 has a fitting section to fit with the fixing structure. When the fixing structure fits with the fitting section, the fastener 4 is secured to a fixed position of the insulative housing 1. Besides, in the present embodiment, the insulative housing 1 further has a pre-fixing structure. When the pre-fixing structure fits with the fitting section, the fastener 4 is pre-fixed to a pre-fixed position of the insulative housing 1.

In detail, the fixing walls 13 at two sides of the rear section 12 each defines a fixing hole 132 extending therethrough along the front to back direction. Two fixing blocks 133 protrude into each fixing hole 132 from opposite inner walls of the fixing hole 132 respectively. The fixing blocks 133 in each fixing hole 132 are arranged in the front to back direction, and one fixing block 133 located at front acts as the fixing structure, and another fixing block 133 acts as the pre-fixing structure.

Please refer to FIGS. 1 to 6, the contacts 2 are assembled to the insulative housing 1 along a back-to-forward direction. Each contact 2 has a retaining portion 21 retained in the passageways 111, a contact portion 22 forwardly extending from the retaining portion 21 and a connecting leg 23 backwardly extending into the rear space 121.

Figure 7:
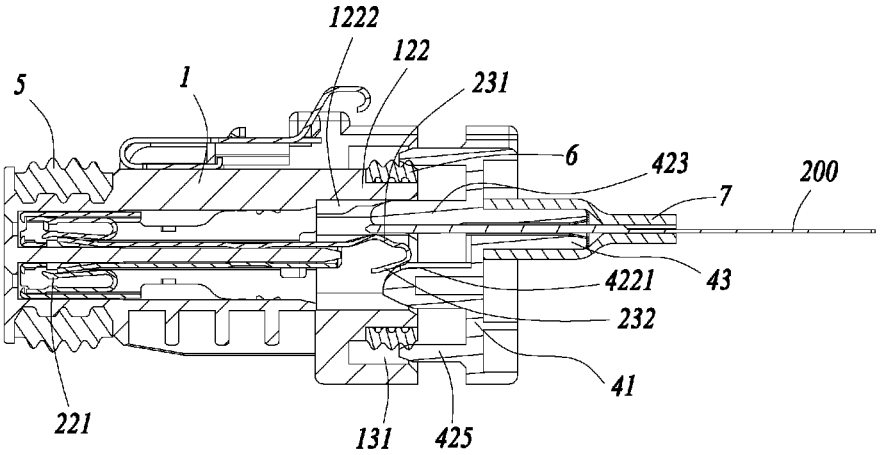
FIG. 7 is a cross-sectional view of the connector and the flexible printed circuit board, shown that the connector is in a pre-fixing state and the connecting legs of the contacts do not connect with the flexible printed circuit board.
Figure 8:
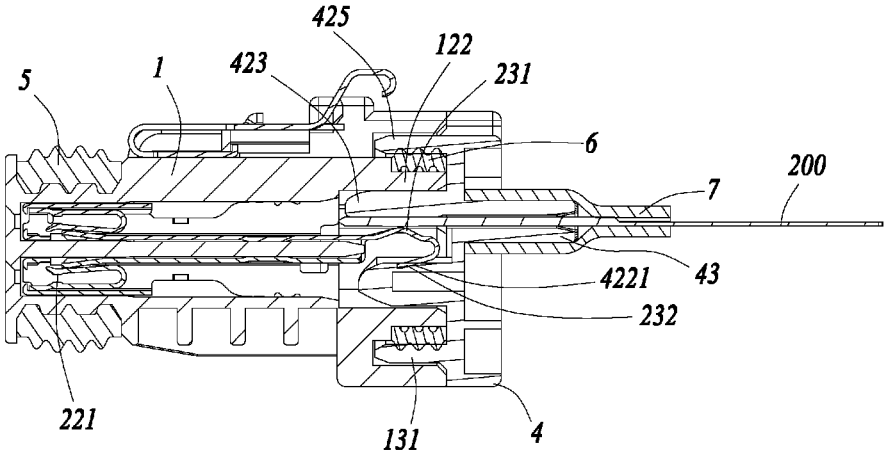
FIG. 8 is a cross-sectional view of the connector and the flexible printed circuit board, shown that the connector is in a fixing state, and the connecting legs of the contacts connect with the flexible printed circuit board.

The retaining portions 21 and the contact portions 22 are arranged in two rows corresponding to the passageways 111. The retaining portions 21 are U-shaped and formed with a plurality of barbs 211 to friction engage with the inner walls of the passageways 111. The contact portions 22 are bended to rectangular tubular shape for receiving a mating pin. Each contact portion 22 is formed with a clamping arm 221 at an inner side thereof to clamp the mating pin (as shown in FIG. 7).

In the present embodiment, all the connecting legs 23 are arranged in a row. In detail, the connecting legs 23 corresponding to the lower row of the contact portions 22 bend upwardly to be located in a row with the other connecting legs 23. Each connecting leg 23 has a connecting portion 231 for connecting with the flexible printed circuit board 200 and a resisting portion 232 connecting with the connecting portion 231. The connecting portions 231 and the resisting portions 232 are located at different lever surfaces.

In the present invention, the connecting portions 231 extend backwardly from a rear end of the retaining portion 21, and each of them is formed with an emboss 2311 protruding outwardly. The resisting portions 232 are bended in a reverse direction from a rear end of the connecting portions 231. The resisting portions 232 extend forwardly and downwardly, thereby the resisting portions 232 can drive the connecting portions 231 moving upwardly when the resisting portions 232 are pressed upwardly.

Please refer to FIGS. 1, 3, 4, 7 and 8, the fastener 4 is provided with a base 41, a mating section 42 forwardly extending from the base 41, an extension section 43 backwardly extending from the base 41, a board receiving chamber 44 extending through the mating section 42 and the base 41 and the extension section 43 along the front to back direction.

The mating section 42 defines a contact receiving chamber 421 communicating with the board receiving chamber 44 along the top to bottom direction and a press section 422. The contact receiving chamber 421 is arranged between the board receiving chamber 44 and the press section 422. The resisting portions 232 are far from the board receiving chamber 44 than the connecting portions 231, and abut against the press section 422 when the fastener 4 is fixed to the insulative housing 1. In the moving process of the fastener 4 toward the fixed position of the insulative housing 1, the press section 422 presses the resisting portions 232 upwardly, then the connecting portions 231 are drove to project into the board receiving chamber 44 and connect with the flexible printed circuit board 200.

Said fitting section of the fastener 4 is presented as a pair of fixing arms 45 extending forwardly from two sides of the base 41. The fixing arms 45 can alternatively fit with the fixing blocks 133 in each fixing hole 132 so as to fix the fastener 4 to the pre-fixed position or fixed position.

When the fastener 4 is pre-fixed at the pre-fixed position, the fixing arms 45 engage with the fixing blocks 133 at rear side of the fixing walls 13, and the rear sides of the connecting legs 23 are received in a front side of the contact receiving chamber 421, and the press section 422 aligns with the resisting portions 232 along the top to bottom direction and does not yet pressing the resisting portions 232.

As moving the fastener 4 to the fixed position, the press section 422 moves into the rear space 121 and presses the resisting portions 232 toward the board receiving chamber 44, then the connecting portions 231 can be drove to project into the board receiving chamber 44 and electrically connect with the flexible printed circuit board 200. At the fixed position, the fixing arms 45 engage with the fixing blocks 133 at the front side of the fixing walls 13, and the press section 422 is kept in resist the resisting portions 232.

Because of the connecting legs 23 are arranged in a row, the mating section 42 is further provided with a limiting wall 423. The board receiving chamber 44 is located between the contact receiving chamber 421 and the limiting wall 423, so that the flexible printed circuit board 200 can be limited from being deformed upwardly. Besides, the mating section 42 further has a pair of spring arm 426 at two sides of the limiting wall 42. Each spring arm 426 is formed with a limiting surfaces 4260 at a front side thereof to limit the flexible printed circuit board 200 from moving backwardly. The first peripheral wall 122 is formed with a pair of projections 1222 corresponding to the spring arms 426. The flexible printed circuit board 200 defines a pair of openings 201 at two sides thereof.

As moving the fastener 4 to the fixed position, the limiting wall 423 and the spring arm 426 moves into the rear space 121, the projections 1222 resist against the spring arms 426 toward the board receiving chamber 44, then the spring arms 426 will protrude into the openings 201, and the limiting surfaces 4260 will abut against the front inner walls of the openings 201 to limit the flexible printed circuit board 200 from moving backwardly.

The press section 422 is present as a press wall perpendicularly extending from the base 41. The press wall is formed with a press surface 4221 toward the board receiving chamber 44 to guide and resist against the resisting portion 232. In detail, the press wall is provided with a plurality of grooves 4222 corresponding to the connecting legs 23 and a plurality of divided walls 4223 between adjacent grooves 4222. The press surface 4221 is the inner surface of groove 4222.

Furthermore, the mating section 42 further has an annular cavity 424 surrounding the press section 422 and the limiting wall 423 and a second peripheral wall 425 around the annular cavity 424. As the fastener 4 is fixed at the fixed position, the press section 422 and the limiting wall 423 is received in the rear space 121, and the second peripheral wall 425 is received in the receiving space 131, and the first peripheral wall 122 is received in the annular cavity 424, thereby the first sealing ring 6 is sandwiched between the first peripheral wall 122 and the second peripheral wall 425 to seal the junction portion between fastener 4 and the insulative housing 1 along the circumferential direction. Then the junction portion between the contacts 2 and the flexible printed circuit board 200 can be protect for waterproof, and the connector 100 can be used reliably.

Besides, the connector 100 further has a heat shrink tube 7 disposed around the flexible printed circuit board 200 and engaging with the extension section 43. The heat shrink tube 7 is formed with a front portion 71 and a rear portion 72 connecting with each other. The front portion 71 rings around the extension section 43, and the rear portion 72 rings around the flexible printed circuit board 200, so that the junction portion of the extension section 43 and the flexible printed circuit board 200 is sealed.

As described above, before assembling the flexible printed circuit board 200 to the connector 100, the fastener 4 is pre-fixed at the pre-fixed position via the fixing arms 45 and the fixing blocks 133 at the rear side, then the flexible printed circuit board 200 can be assembled with zero insertion force.

In assembly of the flexible printed circuit board 200, firstly, assembling the heat shrink tube 7 around the flexible printed circuit board 200; secondly, assembling the heat shrink tube 7 and the flexible printed circuit board 200 to the fastener 4, the flexible printed circuit board 200 passes through the board receiving chamber 44, and the front portion 71 of the heat shrink tube 7 rings around the extension section 43; thirdly, heating the heat shrink tube 7 to make the heat shrink tube 7 be closely attached to the flexible printed circuit board 200 and the extension section 43, then the junction portion between the flexible printed circuit board 200 and the fastener 4 can be sealed; fourthly, moving the fastener 4 forwardly to the fixed position, the connecting portions 231 can be drove to connect with the golden fingers of the flexible printed circuit board 200 gradually in the moving process, and the flexible printed circuit board 200 will be sandwiched between the connecting portions 231 and the limiting wall 423 finally, and the fastener 4 is maintained at the fixed position by the fixing arms 45 and the fixing blocks 133 at the front side, the first sealing ring 6 is sandwiched between the first peripheral wall 122 and the second peripheral wall 425 to seal the junction portion between fastener 4 and the insulative housing 1.

In summary, in the present invention, the flexible printed circuit board 200 and the contact 2 can connect with each other without welding, and the connecting can be reliably ensured via the engagement of the fastener 4 and the insulative housing 1. Besides, the connection between the contacts 2 and the flexible printed circuit board 200 can be protect by the first sealing ring 6, thereby the connector 100 can be ensured to have a reliable signal transmission. Moreover, the heat shrink tube 7 and the second sealing ring 5 can further strengthen the waterproof to protect the connector 100 comprehensively.

In addition, in the present embodiment, the first sealing ring 6 is retained on the first peripheral wall 122 and sandwiched between the first peripheral wall 122 and the second peripheral wall 425 finally. In the other embodiment, the first sealing ring 6 can be alternatively arranged to ring around the limiting wall 423 and the press wall, then the first sealing ring 6 resists the inner surface of the first peripheral wall 122 to seal the junction portion between the fastener 4 and the insulative housing 1, and the second peripheral wall 425 can be removed. So as, the first seal ring 6 is provided at the periphery of the connection between the conductive terminal 2 and the flexible printed circuit board 200, the connector 100 can be ensured to have a reliable connection.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A connector for flexible printed circuit board, comprising:

an insulative housing having a rear section extending backwardly, the rear section having a rear space and a first peripheral wall around the rear space;

a plurality of contacts retained in the insulative housing, each contact having a connecting leg extending into the rear space, each connecting leg having a connecting portion and a resisting portion connecting with each other, the connecting portion and the resisting portion of each connecting leg being located at different level surfaces;

a fastener having a base, a mating section forwardly extending from the base and a board receiving chamber extending therethrough along a front to back direction, the mating section defining a contact receiving chamber communicating with the board receiving chamber along a top to bottom direction and a press section;

a first sealing ring being arranged between the first peripheral wall and the mating section of the fastener;

wherein the insulative housing has a fixed position to fix the fastener, and as moving the fastener to the fixed position, the press section presses against the resisting portion to drive the connecting portion projecting into the board receiving chamber, and the first sealing ring is sealed between the first peripheral wall and the mating section.

2. The connector for flexible printed circuit board as claimed in claim 1, wherein the mating section further has an annular cavity corresponding to the first peripheral wall and a second peripheral wall around the annular cavity, as the fastener is fixed at the fixed position, the first peripheral wall is received in the annular cavity, and the first sealing ring is sandwiched between the first peripheral wall and the second peripheral wall.

3. The connector for flexible printed circuit board as claimed in claim 2, wherein the first peripheral wall defines a recess recessed from outer surface thereof, the first sealing ring is retained in the recess.

4. The connector for flexible printed circuit board as claimed in claim 1, wherein the connecting legs of all contacts are arranged in a row, the press section is present as a press wall perpendicularly extending from the base, and the press wall is formed with a press surface toward the board receiving chamber to guide and resist against the resisting portion, the mating section further has a limiting wall adjacent to the board receiving chamber for limiting the flexible printed circuit board from being deformed outwardly.

5. The connector for flexible printed circuit board as claimed in claim 4, wherein the press wall defines a plurality of grooves corresponding to the contacts and a plurality of divided walls between adjacent grooves, the press surface is an inner surface of the groove.

6. The connector for flexible printed circuit board as claimed in claim 4, wherein the mating section further has a pair of spring arms at two sides of the limiting wall, and each spring arm is formed with a limiting surface to limit the flexible printed circuit board from moving backwardly, the first peripheral wall is formed with a pair of projections corresponding to the spring arms, the projections resist against the spring arms toward the board receiving chamber as moving the fastener to the fixed position.

7. The connector for flexible printed circuit board as claimed in claim 1, wherein the fastener further has an extension section backwardly extending from the base, the board receiving chamber extends through the extension section backwardly, and the connector further has a heat shrink tube setting around the flexible printed circuit board and attached to the extension section.

8. The connector for flexible printed circuit board as claimed in claim 1, wherein the insulative housing further has a body section at a front side of the rear section, the body section defines an annular slot recessed from the outer surfaces thereof, the connector further has a second sealing ring retained in the annular slot.

9. The connector for flexible printed circuit board as claimed in claim 1, wherein the connecting portions extend backwardly in the rear space, the resisting portions are bended in a reverse direction from a rear end of the connecting portions, and the connecting portion is formed with an emboss protruding outwardly.

10. The connector for flexible printed circuit board as claimed in claim 1, wherein the insulative housing further has a body section at a front side of the rear section and a pair of fixing walls at two sides of the rear section, each fixing wall is formed with a fixing hole and a pair of fixing blocks protruding into the fixing hole, the fixing blocks in each fixing hole are arranged in the front to back direction, the fastener is further provided with a pair of fixing arms at two sides thereof, the fixing arms can alternatively engage with the fixing blocks to pre-fix or fix the fastener to the insulative housing.

11. A connector for flexible printed circuit board, comprising:

an insulative housing having a rear section extending backwardly, the rear section having a rear space and a first peripheral wall around the rear space;

a plurality of contacts retained in the insulative housing, each contact having a connecting leg extending into the rear space;

a fastener having a mating section to engage with the rear section and a board receiving chamber extending therethrough along a front to back direction;

a first sealing ring;

wherein the insulative housing has a fixed position to fix the fastener, and as moving the fastener to the fixed position, the connecting legs are pressed into the board receiving chamber for electrically connecting with the flexible printed circuit board, and the first sealing ring is sealed around a junction of the contacts and the flexible printed circuit board.

12. The connector for flexible printed circuit board as claimed in claim 11, wherein the fastener is moved to the fixed position along a back to front direction, the mating section further has an annular cavity corresponding to the first peripheral wall and a second peripheral wall around the annular cavity, as the fastener is fixed at the fixed position, the first peripheral wall is received in the annular cavity, and the first sealing ring is sandwiched between the first peripheral wall and the second peripheral wall.

13. The connector for flexible printed circuit board as claimed in claim 12, wherein the first peripheral wall defines a recess recessed from outer surface thereof, the first sealing ring is retained in the recess.

14. The connector for flexible printed circuit board as claimed in claim 11, wherein the fastener further has a base and an extension section backwardly extending from the base, the mating section extends forwardly from the base, the board receiving chamber extends through the extension section backwardly, and the connector further has a heat shrink tube setting around the flexible printed circuit board and attached to the extension section.

15. The connector for flexible printed circuit board as claimed in claim 11, wherein the insulative housing further has a body section at a front side of the rear section, the body section defines an annular slot recessed from an outer surface thereof, the connector further has a second sealing ring retained in the annular slot.

* * * * *